US008647083B2

(12) United States Patent
Ford

(10) Patent No.: US 8,647,083 B2
(45) Date of Patent: Feb. 11, 2014

(54) PLUNGER FOR A SUCKER ROD PUMP

(76) Inventor: Michael Brent Ford, St. George, UT (US)

( * ) Notice: Subject to any disclaimer, the term of this patent is extended or adjusted under 35 U.S.C. 154(b) by 1005 days.

(21) Appl. No.: 11/842,300

(22) Filed: Aug. 21, 2007

(65) Prior Publication Data

US 2009/0053087 A1 Feb. 26, 2009

(51) Int. Cl.

| | |
|---|---|
| ***F04B 39/10*** | (2006.01) |
| ***F04B 53/12*** | (2006.01) |
| ***F04B 53/00*** | (2006.01) |

(52) U.S. Cl.

USPC ..... 417/555.2; 417/555.1; 417/554; 166/105.2

(58) Field of Classification Search

USPC ..... 417/555.2, 555.1, 554, 430; 166/105.1, 166/105.2

See application file for complete search history.

(56) References Cited

U.S. PATENT DOCUMENTS

| | | | | |
|---|---|---|---|---|
| 1,588,705 | A * | 6/1926 | Cope | 417/459 |
| 2,802,535 | A * | 8/1957 | Taylor | 166/170 |
| 4,395,204 | A * | 7/1983 | Turner | 417/554 |
| 5,120,203 | A * | 6/1992 | Priestly | 417/554 |
| 5,618,169 | A * | 4/1997 | Smith | 417/554 |
| 6,685,451 | B1 * | 2/2004 | Ivey | 417/555.2 |
| 7,008,197 | B2 * | 3/2006 | Ford | 417/430 |
| 2005/0265875 | A1 * | 12/2005 | Williams et al. | 417/555.1 |

* cited by examiner

*Primary Examiner* — Peter J Bertheaud
(74) *Attorney, Agent, or Firm* — Weiss & Moy, P.C.; Jeffrey D. Moy

(57) ABSTRACT

An improved plunger has a north end, a south end, and a center region therebetween. A first northward angled shoulder is provided proximate the north end, for catching solids and preventing them from damaging an exterior of the plunger below the shoulder and potentially other pump components. In one embodiment, first and second northward angled shoulders are provided proximate the north end. First and second southward angled shoulders may be provided proximate the south end, making the plunger invertible when the north end becomes worn. The plunger may be comprised of separable regions, having different hardnesses. In one embodiment, the shoulders may provide a tapered outside diameter for the plunger.

14 Claims, 2 Drawing Sheets

PLUNGER FOR A SUCKER ROD PUMP

FIELD OF THE INVENTION

The present invention relates to mechanical oil pumps actuated by sucker rod reciprocation. More particularly, the invention relates to an improved sucker rod pump having improved solids removal capabilities.

BACKGROUND OF THE INVENTION

In general terms, an oil well pumping system begins with an above-ground pumping unit, which creates the up and down pumping action that moves the oil (or other substance being pumped) out of the ground and into a flow line, from which the oil is taken to a storage tank or other such structure.

Below ground, a shaft is lined with piping known as "tubing." Into the tubing is inserted a sucker rod, which is ultimately, indirectly, coupled at its north end to the pumping unit. Below the sucker rod are located a number of pumping system components, including the cage and, below the cage, the plunger. The plunger operates within a barrel, which barrel is positioned within the tubing.

The amount of space between the exterior surface of the plunger and the interior surface of the barrel can be as great as 0.012". This space allows a constant passage of fluid, including debris, between the plunger exterior and the barrel interior. The debris that is contained within the fluid and that passes through the space between plunger and barrel scores the plunger and the barrel, reducing the operating life of both.

The present invention is concerned with providing an improved plunger, having a debris removal capability and wear resistance.

SUMMARY OF THE INVENTION

In accordance with an embodiment of the present invention, an improved plunger for a pumping apparatus is disclosed. The plunger comprises, in combination: a threaded north end; a threaded sound end; a center region between the threaded north end and the threaded south end; wherein an interior channel extends through the threaded north end, the threaded south end, and the center region; and a first northward angled shoulder located below the threaded north end.

In accordance with another embodiment of the present invention, an improved plunger for a pumping apparatus is disclosed. The plunger comprises, in combination: a threaded north end; a threaded sound end; a center region between the threaded north end and the threaded south end; wherein an interior channel extends through the threaded north end, the threaded south end, and the center region; a first northward angled shoulder located below the threaded north end; and a second northward angled shoulder located below the first northward angled shoulder; wherein a north region, comprising a portion of the plunger extending from the north In accordance with a further embodiment of the present invention, an improved plunger for a pumping apparatus is disclosed. The plunger comprises, in combination: a threaded north end; a threaded sound end; a center region between the threaded north end and the threaded south end; wherein an interior channel extends through the threaded north end, the threaded south end, and the center region; a first northward angled shoulder located below the threaded north end; a second northward angled shoulder located below the first northward angled shoulder; wherein a north region, comprising a portion of the plunger extending from the north end to below the second northward angled shoulder, is a separable component from the center region; a first southward angled shoulder located above the threaded south end; and a second southward angled shoulder located above the first southward angled shoulder; wherein a south region, comprising a portion of the plunger extending from the south end to above the second southward angled shoulder, is a separable component from the center region and from the north region; and wherein each of the north region and the south region has a Rockwell hardness of in the range of between about 72 and 98 and the center region has a Rockwell hardness of between about 45 and 62.

DETAILED DESCRIPTION OF THE PREFERRED EMBODIMENTS

Figure 1:
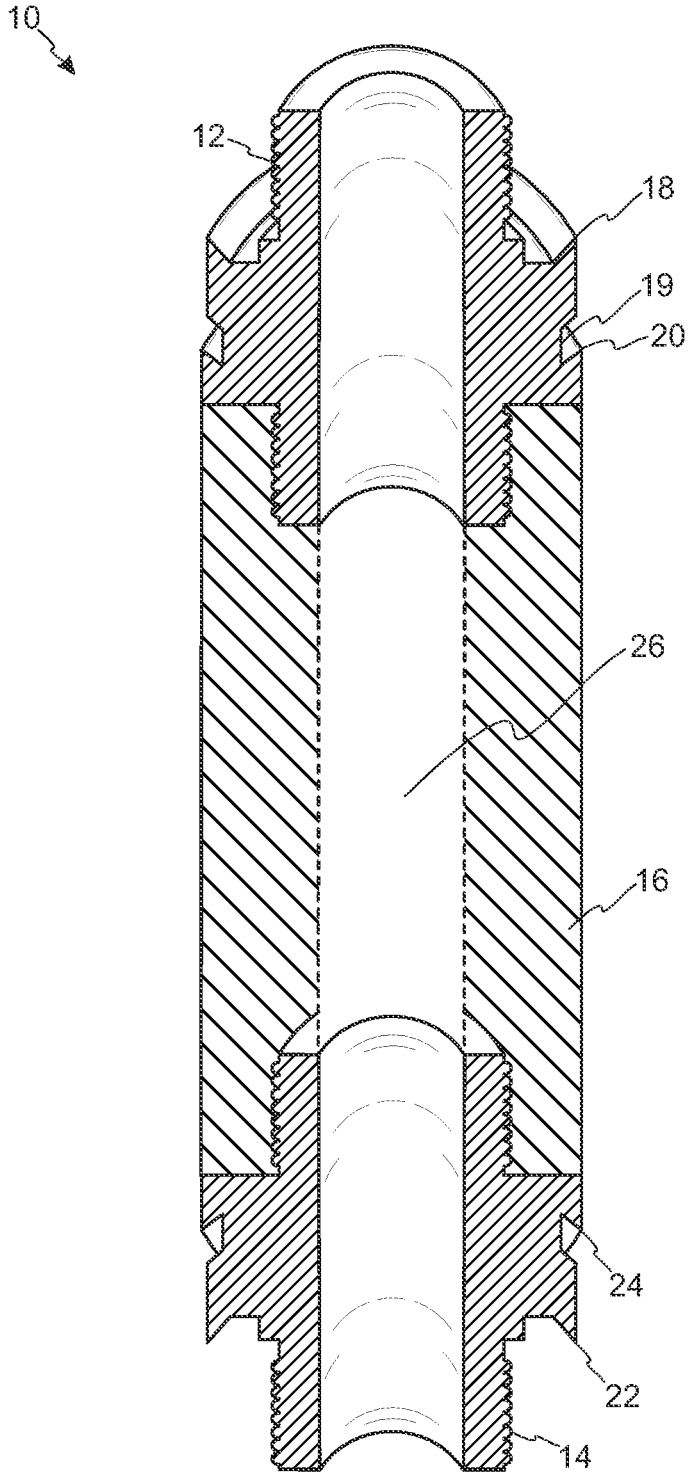
FIG. 1 is a side, cross-sectional view, illustrating an improved plunger consistent with an embodiment of the present invention.

Referring first to FIG. 1, an improved plunger 10 consistent with an embodiment of the present invention is shown. As shown, the plunger 10 has a threaded north end 12 and a threaded south end 14, with a center region 16 therebetween. (It should be noted that while the north end 12 and south end 14 are illustrated as male components, they may be configured as female threaded components without departing from the spirit or scope of the present invention.)

The plunger 10 is hollow, and channel 26 extends therethrough. In one embodiment, a first shoulder 18 is provided below north end 12, and a second shoulder 20 is provided below the first shoulder 18, creating groove 19. Shoulders 18 and 20 are preferably, as shown in FIG. 1, upwardly (i.e., northwardly) angled. The portion of the plunger 10 located above the center region 16 and including the north end 12 and first and second shoulders 18 and 20 and groove 19 may be referred to herein as the north region.

In one embodiment, the outer diameter of the plunger 10, in the area of shoulders 18 and 20, is the same as that of center region 16. In one embodiment, it may be desired to provide a plunger 10 in which the outer diameter, at shoulder 18, is less than that of the center region 16. For example, if the outer diameter at center region 16 is 1.50", it may be desired to provide an outer diameter in the region of shoulder 18 of 1.30". The outer diameter, at shoulder 20, may in this embodiment be the same as that of center region 16.

A tapered design, as described in the preceding paragraph, may provide one or more advantages. For example, a tapered design may compensate for barrel flexing during pumping operations. If the shoulder 18 is not provided with a reduced outside diameter, contact between it and the barrel (not shown) during pumping may be possible, causing damage to the barrel. The provision of a taper can reduce this possibility.

In one embodiment, a first shoulder 22 is provided above south end 14, and a second shoulder 24 is provided above the first shoulder 22. Shoulders 22 and 24 are preferably, as shown in FIG. 1, downwardly (i.e., southwardly) angled. The portion of the plunger 10 located below the center region 16 and including the south end 14 and first and second shoulders 22 and 24 may be referred to herein as the south region.

In one embodiment, the outer diameter of the plunger 10, in the area of shoulders 22 and 24, is the same as that of center region 16. In one embodiment, as described above with respect to shoulders 18 and 20, it may be desired to provide a plunger 10 in which the outer diameter, at shoulder 22, is less than that of the center region 16. For example, if the outer diameter at center region 16 is 1.50", it may be desired to provide an outer diameter in the region of shoulder 22 of 1.30". The outer diameter, at shoulder 24, may in this embodiment be the same as that of center region 16.

As described in more detail below, the configuration as shown in FIG. 1 is invertible. In use, the north region will experience relatively greater wear. As an alternative to replacing a worn plunger 101 it may be possible to instead invert the plunger 10, so that the north region becomes the south region, and the south region becomes the north region. However, it should be noted that it may be desired to provide a plunger 10 having only a first shoulder 18 and a second shoulder 20.

In one embodiment, the entire plunger 10 may be a one-piece assembly. Alternatively, as illustrated in FIG. 1, it may be a multi-piece assembly, wherein, for example, the north region, center region 16, and south region are each separable components. Where only a first shoulder 18 and second shoulder 20 are provided, a two-component plunger 10 may be provided.

An advantage of forming the plunger 10 from multiple components is that such a configuration more readily facilitates the provision of a plunger 10 having different hardnesses in different regions. For example, it may be desired to provide a plunger 10 having a nickel-coated center region with a Rockwell hardness in the range of between about 45 and 62, and carbide coated north and south regions having a Rockwell hardness in the range of between about 72 and 98. (These ranges are exemplary, and hardnesses outside of them may confer at least a substantial portion of the benefits of the present invention.) This configuration is reflective of the fact that most of the wear experienced on a plunger 10 occurs near the upper portion thereof, in the region of the north end 12, extending about eight inches therebelow.

The first and second shoulders 18 and 20 are positioned so as to trap solids therein during the upstroke, and to prevent the solids from sliding past the plunger, scoring its exterior, and potentially damaging other pump components. During the downstroke, the trapped solids are drawn northward, and ultimately out of the pump barrel. The shoulders 18 and 20 also act to create a 360 degree hydraulic seal, by using upstroke energy to create cyclonic forces that forces fluid away that would otherwise seek to pass through the clearance between the plunger and barrel on the upstroke.

Figure 2:
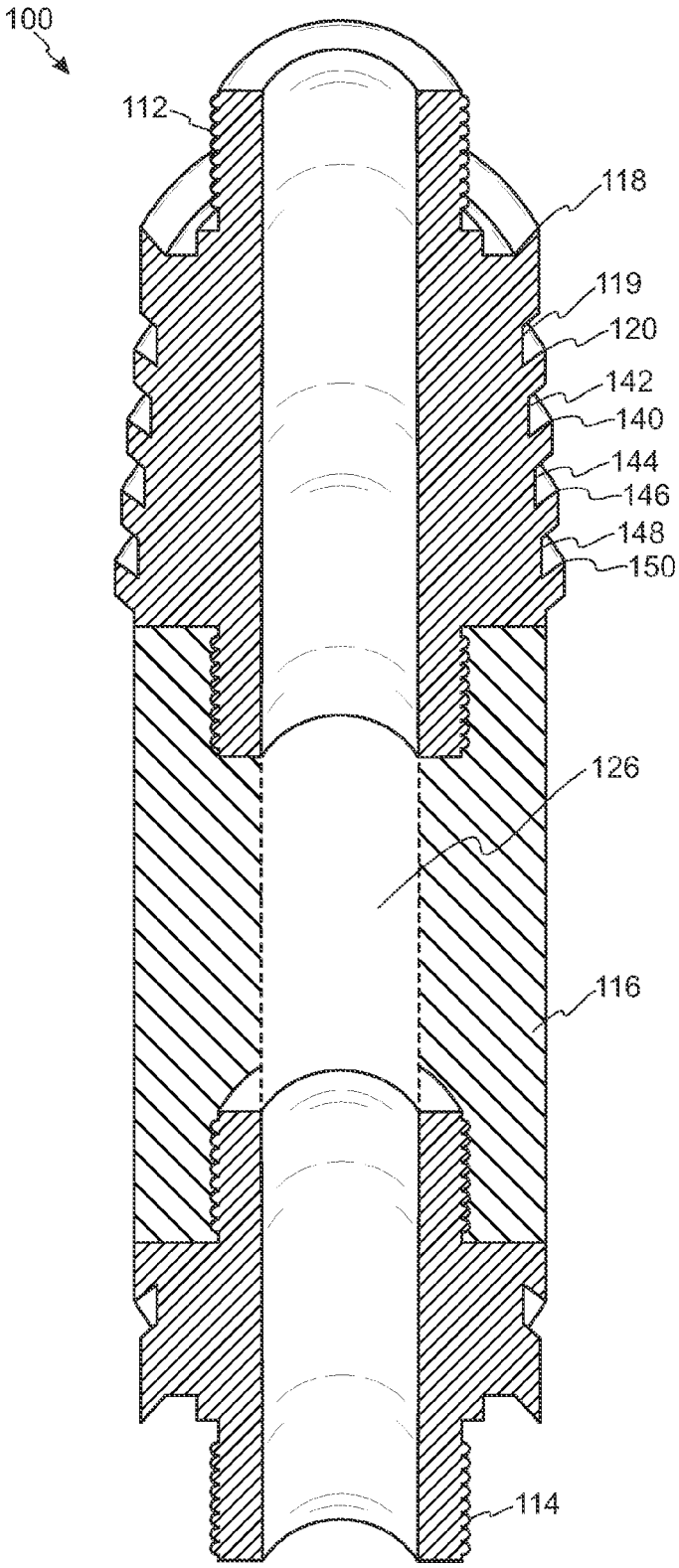
FIG. 2 is a side, cross-sectional view, illustrating an improved plunger consistent with another embodiment of the present invention.

Referring now to FIG. 2, an embodiment of a plunger 100 consistent with an embodiment of the present invention is shown. As shown, the plunger 100 has a threaded north end 112 and a threaded south end 114, with a center region 116 therebetween. (It should be noted that while the north end 112 and south end 114 are illustrated as male components, they may be configured as female threaded components without departing from the spirit or scope of the present invention.)

The plunger 100 is hollow, and channel 126 extends therethrough. In one embodiment, a first shoulder 118 is provided below north end 112, a second shoulder 120 is provided below the first shoulder 118, creating groove 119. Therebelow, a third shoulder 140 is provided, creating groove 142, followed by groove 144 and fourth shoulder 146, and followed by groove 148 and fifth shoulder 150. While five shoulders are illustrated in Figure, it should be apparent that three grooves, four grooves, or more than five grooves may be provided as desired.

As discussed above with respect to shoulders 18 and 20, the shoulders of plunger 100 may be of the same outside diameter as the center region 116 or, alternatively, may provide a taper. For example, the first shoulder 118 may be less than that of the center region 116. For example, if the other diameter at center region 116 is 1.50", it may be desired to provide an outer diameter in the region of shoulder 118 of 1.30". The outer diameter, at second shoulder 120, may be the same as that of shoulder 118 or, alternative, as center region 116.

The outer diameter at fifth shoulder 150 may be the same as center region 116. The tapering from first shoulder 118 to fifth shoulder 150 may increment or, alternatively, first and second shoulders 118 and 120 may have a reduced diameter, while third, fourth and fifth shoulders 140, 146 and 150 may have the same outer diameter as center region 116. Other variations are possible. As discussed above with respect to plunger 10, plunger 100 may be provided in a fully invertible configuration, so that the north and south regions have identical—though inverted—configurations. Alternatively, as shown in FIG. 2, the north and south regions may be differently configured with respect to the number and/or size of their associated shoulders, so as to provide a user with the ability to select a preferred orientation based on particular pumping conditions or the like.

While the invention has been particularly shown and described with reference to preferred embodiments thereof, it will be understood by those skilled in the art that the foregoing and other changes in form and details may be made therein without departing from the spirit and scope of the invention.

I claim:

1. An improved plunger for a pumping apparatus comprising, in combination:

a threaded north end configured to connect with a pump rod;

a threaded south end;

a center region between the threaded north end and the threaded south end;

an interior channel extending through the threaded north end, the threaded south end, and the center region;

a first shoulder located below and extending from the threaded north end capable of connecting with a pump rod, the first shoulder having a right triangular cross section wherein a height of the right triangular cross section is on an outer diameter of the first shoulder; and one or more shoulders located below the first shoulder, the one or more shoulders having a right triangular cross section wherein a height of the right triangular cross section is on an outer diameter of the one or more shoulders;

wherein the first shoulder and the one or more shoulders located below the first shoulder are angled upwardly towards the north end; and wherein the outer diameter of the first shoulder is less than that of the center region in order to prevent contact between the first shoulder and a surrounding barrel.

2. The improved plunger of claim 1 further comprising a first shoulder located above and extending from the threaded south end, the first shoulder located above and extending from the threaded south end having a right triangular cross section wherein a height of the right triangular cross section is on an outer diameter of the first shoulder located above and extending from the threaded south end.

3. The improved plunger of claim 2 further comprising a second shoulder located above the first shoulder located above and extending from the threaded south end, the second shoulder located above the first shoulder located above and extending from the threaded south end having a right triangular cross section wherein a height of the right triangular cross section is on an outer diameter of the second shoulder located above the first shoulder located above and extending from the threaded south end.

4. The improved plunger of claim 1 wherein a north region, comprising a portion of the plunger extending from the north end to below the first shoulder located below and extending from the threaded north end, is a separable component from the center region.

5. The improved plunger of claim 3 wherein a north region, comprising a portion of the plunger extending from the north end to below the first shoulder located below and extending from the threaded north end, is a separable component from the center region and from a south region, the south region comprising a portion of the plunger extending from the south end to above the second shoulder located above the first shoulder located above and extending from the threaded south end.

6. The improved plunger of claim 4 wherein the north region has a greater hardness than the center region.

7. The improved plunger of claim 1 wherein the outer diameter of the first shoulder is less than that of at least one of the one or more shoulders located therebelow.

8. An improved plunger for a pumping apparatus comprising, in combination:

a threaded north end configured to connect with a pump rod;

a threaded south end;

a center region between the threaded north end and the threaded south end;

an interior channel extending through the threaded north end, the threaded south end, and the center region;

a first northward angled shoulder having an outer diameter located below and extending from the threaded north end; and a second northward angled shoulder having an outer diameter located below the first northward angled shoulder located below and extending from the threaded north end, wherein the outer diameter of the first northward angled shoulder is the same as the outer diameter of the second northward angled shoulder;

wherein a north region, comprising a portion of the plunger extending from the north end to below the second northward angled shoulder, is a separable component from the center region; and wherein the outer diameter of the first northward angled shoulder and the outer diameter of the second northward angled shoulder are less than that of the center region in order to prevent contact between the first shoulder and a surrounding barrel.

9. The improved plunger of claim 8 further comprising a first southward angled shoulder located above and extending from the threaded south end.

10. The improved plunger of claim 9 further comprising a second southward angled shoulder located above the first southward angled shoulder located above and extending from the threaded south end.

11. The improved plunger of claim 10 wherein the north region is a separable component from the center region and from a south region, the south region comprising a portion of the plunger extending from the south end to above the second southward angled shoulder.

12. The improved plunger of claim 8 wherein the north region has a greater hardness than the center region.

13. An improved plunger for a pumping apparatus comprising, in combination:

a threaded north end configured to connect with a pump rod;

a threaded south end;

a center region between the threaded north end and the threaded south end;

wherein an interior channel extends through the threaded north end, the threaded south end, and the center region;

a first northward angled shoulder having an outer diameter located below and extending from the threaded north end;

a second northward angled shoulder having an outer diameter located below the first northward angled shoulder located below and extending from the threaded north end, wherein the outer diameter of the first northward angled shoulder is the same as the outer diameter of the second northward angled shoulder;

wherein a north region, comprising a portion of the plunger extending from the north end to below the second northward angled shoulder, is a separable component from the center region;

a first southward angled shoulder having an outer diameter located above and extending from the threaded south end; and a second southward angled shoulder having an outer diameter located above the first southward angled shoulder located above and extending from the threaded south end;

wherein a south region, comprising a portion of the plunger extending from the south end to above the second southward angled shoulder, is a separable component from the center region and from the north region;

wherein the outer diameter of the first northward angled shoulder and the outer diameter of the second northward angled shoulder are less than that of the center region; and wherein the outer diameter of the first southward angled shoulder and the outer diameter of the second southward angled shoulder are less than that of the center region.

14. The improved plunger of claim 13 wherein the threaded north end and the threaded south end have identical threading so that the plunger is invertible and may be coupled to the pump rod by either of the north end and the south end.

* * * * *